United States Patent [19]

Rodney

[11] Patent Number: 4,590,593

[45] Date of Patent: May 20, 1986

[54] ELECTRONIC NOISE FILTERING SYSTEM

[75] Inventor: Paul F. Rodney, Spring, Tex.

[73] Assignee: NL Industries, Inc., New York, N.Y.

[21] Appl. No.: 509,487

[22] Filed: Jun. 30, 1983

[51] Int. Cl.[4] ..... G01V 1/36

[52] U.S. Cl. ..... 367/83; 367/43; 367/901; 455/304

[58] Field of Search ..... 367/81-85, 367/901, 43, 45, 40; 381/94, 71, 56, 121, 108; 340/566, 683, 531; 375/102, 103; 73/151, 1 DV, 4 R; 33/307; 175/48, 50; 364/422, 724; 324/83 FE, 77 R, 77 H, 77 A; 307/358; 328/167, 55, 56, 162; 455/303-306, 307, 339, 222, 223

[56] References Cited

U.S. PATENT DOCUMENTS

| | | | |
|---|---|---|---|
| 3,488,629 | 1/1970 | Claycomb | 367/83 |
| 3,716,830 | 2/1973 | Garcia | 367/83 |
| 3,742,443 | 6/1973 | Foster et al. | 367/83 |
| 4,025,724 | 5/1977 | Davidson, Jr. et al. | 381/71 |
| 4,215,425 | 7/1980 | Waggener | 367/83 |
| 4,232,399 | 11/1980 | Heiter | 455/304 X |
| 4,243,935 | 1/1981 | McCool et al. | 367/901 X |
| 4,262,343 | 4/1981 | Claycomb | 175/48 X |
| 4,334,316 | 6/1982 | Tanaka | 455/304 X |

*Primary Examiner*—David H. Brown

*Assistant Examiner*—John E. Griffiths

*Attorney, Agent, or Firm*—Browning, Bushman, Zamecki & Anderson

[57] ABSTRACT

An electronic noise filtration system for use in improving the signal to noise ratio of acoustic data transmitted from a downhole transducer in a measurement while drilling system. Signals from a pair of receiving acoustic transducers located in the mud flow path directed downhole are input to a differencing amplifier. The RMS output of the amplifier is converted from an analog to a digital signal and then processed by a computer programmed with a least mean squares technique for minimizing the signal. The input from one receiving transducer is routed through a delay line wherein a programmable clock controls the timing of the signal delay. The delay time is controlled and adjusted by the computer's calculation of the frequency with which the clock should drive the delay line to minimize the difference between the two received transducer signals. This function minimizes ambient noise in the acoustic transmission line formed by the column of drilling fluids when no data transmissions are being made. Computer analysis and adjustment of the delay time effectively maximizes filtration of acoustic noise due to mud pump pulses and or reflections of noise from the pump thereof without limitation to the geometrical configuration or other noise related variables.

18 Claims, 6 Drawing Figures

ELECTRONIC NOISE FILTERING SYSTEM

BACKGROUND OF THE INVENTION

1. Field of the Invention

The invention relates to the telemetry of downhole data in a measurement while drilling system, and more particularly, to a method and apparatus for the transmission of acoustic data and the filtration of acoustic noise within a stream of flowing drilling fluids.

2. History of the Prior Art

In the oil industry, receiving data from downhole sensors during a drilling operation provides information which is of great value to the drilling operator. Such data transmissions may generally be referred to as being part of a "measuring while drilling" (MWD) system. Downhole measured parameters such as weight on the bit, fluid pressures, fluid temperatures, formation nature, gamma ray measurements and accelerometer data indicative of the inclination of the drill stem adjacent the drill bit all vary with time. These parameters are of great interest for effecting the formation of the borehole in the most efficient and economical manner and their transmission is thus a critical feature of the drilling operation.

Many different prior art techniques have been proposed for effecting the telemetry of data downhole. Such information is generally measured by sensors located near the drill bit and relayed to the surface in order to make the data readily available for analysis during the drilling operation. The telemetry, or relay system, is thus an integral part of the operation and a myriad of telemetry techniques have been employed. For example, it has been proposed to utilize the metal drill string as a carrier for both acoustic and electrical signals as well as the flow conduit for drilling fluids. Such drill string communication links carry digitally encoded information from within the borehole to the surface well head. It has been established that of all these techniques, the use of acoustic pressure pulses imposed upon the column of flowing drilling fluids within the drill string has proven to be the most effective transmission medium for data relay of monitored downhole parameters.

It is conventional in the prior art to supply a stream of drilling fluid into the borehole by relatively large pumps located at the well head. The drilling fluid, or mud, is pumped under pressure down the central opening in the drill string at the well head to force the mud through the string and out apertures located in the bit. This flow cools and lubricates the bit and carries off pieces of the formation cut by the bit during the drilling operation. The mud flows back to the surface in the annular space between the outer walls of the drill string and the sides of the borehole. At the well head, the mud is routed by conduit from the mouth of the borehole to a fluid storage pit and/or mud processing equipment located at the surface. Such equipment may include degassing units and mud filtration systems which prepare the fluids for subsequent conveyance downhole.

Drilling fluid is conventionally forced down into the drill string by means of large reciprocating piston pumps. Such units must generally have a capacity for moving from 600 to 1,000 barrels of fluid per hour down into a borehole and back out again. For this reason, great force is needed and the pressure impulses generated in the column of drilling fluids by the reciprocating circulation pumps are quite large. The pumping action thus creates a very noisy acoustical environment within the drilling fluids. Such noise obviously interferes with the relatively low level transmission of acoustic data pulses of a downhole telemetry system utilizing the drilling fluid as a transmission medium. In addition, the high pressure acoustic pulses generated by the pumps are also reflected from each discontinuity in the flow path. Such discontinuities occur where the various sections of conduits are coupled for directing fluids into and out of the borehole. It may thus be seen that acoustic data signals transmitted from within the borehole and which are to be received and analyzed by receiving transducers located at the well head are virtually buried within a large quantity of acoustic noise. The transmission signals must therefore be extracted from the background noise before the borehole data can be analyzed to provide useful information to the drilling operator.

Various prior art techniques have been proposed for reducing the acoustic noise level in the drilling fluid stream to aid in the reception of data. For example, one technique is shown in U.S. Pat. No. 3,488,629 wherein pump noise impulses are filtered from the fluid line by simultaneously supplying the impulses to both inputs of a differential pressure detecting meter. The simultaneous receipt of pump pressure pulses is caused by two equal path lengths for pressure communication from the pump. However, the differential pressure detecting meter has two unequal pressure path lengths as seen from the borehole side. This is effected simply by meter location within the meter input flow line. In this manner, pressure pump impulses cancel one another but downhole transducer impulses produce a differential output signal. A similar technique is disclosed in U.S. Pat. No. 3,716,830 which teaches cancellation of both mud pump pulses as well as conduit and impedance mismatch reflections thereof by applying received signals from two acoustic transducers through a differential amplifier. One of the transducer signals is phase shifted corresponding to the delay time in the reflected signal to cancel both mud pump pulses and unwanted reflections thereof to thereby isolate acoustic pulses from the downhole transducer.

The aforesaid prior art techniques specifically address and are necessarily dependent upon the geometry of the fluid flow system and transducer spacing therein. A particular flow geometry must be maintained in order to successfully eliminate acoustic noise from the drilling fluid flow path for improvement of the reception of acoustic data signals from downhole. Drill string and pumping configurations vary, however, and many prior art preprogrammed filtration patterns can quickly become out of phase and cannot be automatically calibrated. It would be an advantage to provide a system for filtering of acoustic noise from the drilling fluid flow which is independent of specific geometrics and specific transducer spacings. Moreover, it is desirable to provide a noise filter system which is universally applicable to any fluid flow stream used as an acoustic transmission line for improving the signal to noise ratio of acoustic data transmitted thereby.

SUMMARY OF THE INVENTION

In accordance with the objects of the present invention, a pair of receiving acoustic transducers are disposed in communication with a downhole acoustic data transducer. Acoustic signals are transmitted in the flow path of the drilling fluids in a borehole and received by transducers spaced from one another an arbitrary distance. The output of the receiving transducers farthest from the borehole is connected directly to one input of a differencing amplifier and the receiving transducer nearest the downhole transducer is directed through a delay line before being connected to the other input of the differencing amplifier. The output of the differencing amplifier is converted to a root mean square (RMS) value and passed through an analog to a digital converter and input to the central processing unit (CPU) of a computing system. The computer drives a programmable clock which controls the time delay of the delay line through which signals are input to the differencing amplifier. The computer adjusts the delay time through the programmable clock so that the output of the differencing amplifier is at a minimum value when no data is being transmitted. The computer uses a least mean squares technique of selecting various clock frequencies and evaluating the output signal produced thereby to adjust the delay time. The output signal level of the differencing amplifier is minimized when no data is being transmitted and only unwanted acoustic noise from the mud pump and reflections within the drilling fluid flow line are present. The system thus eliminates acoustic noise from the flow path without regard to the geometry thereof and thereby improves the quality of the signal received from the acoustic data transducers downhole.

BRIEF DESCRIPTION OF THE DRAWINGS

The novel features of the present invention are set forth with particularity in the appended claims. The invention, together with further object and advantages thereof may be best understood by way of the following description of exemplary apparatus employing the principles of the invention as illustrated in the accompanying drawings, in which:

DETAILED DESCRIPTION OF THE PREFERRED EMBODIMENTS

Figure 1:
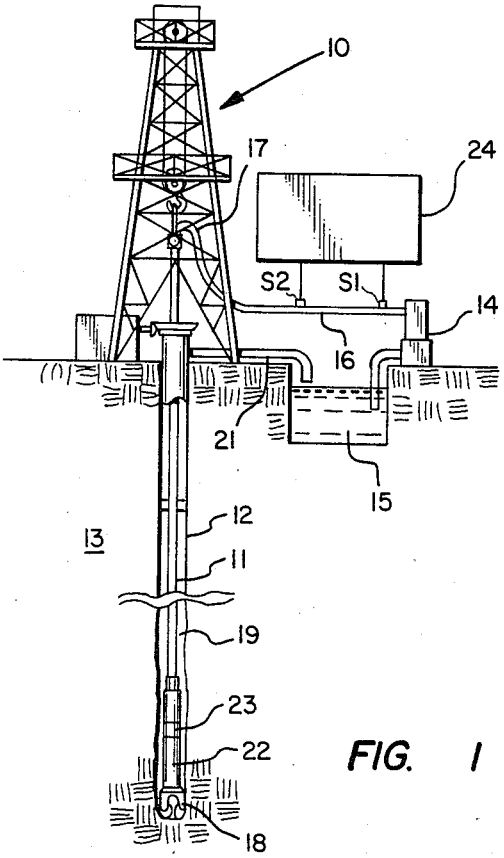
FIG. 1 is a schematic illustration showing the system of the present invention in use in conjunction with a downhole measuring while drilling pressure pulse telemetry system.

Referring first to FIG. 1, there is shown a conventional drilling rig structure 10 for producing a well. The rig 10 includes a drill string 11 positioned in a borehole 12 penetrating earth formation 13. A pump 14 causes mud, or drilling fluid, from a mud pit 15 to flow through a feed conduit 16 into a flexible hose 17 and down a central opening in the drill string 11. The mud egresses under pressure from apertures in the drill pit 18 and returns to the surface through the annular space 19 between the drill string 11 and the walls of the borehole 12. At the surface, the drilling fluids are conducted from the annular space 19 through a return conduit 21 into the mud pit 15.

Data concerning the downhole drilling conditions are telemetered back to the surface from a signaling device disposed downhole. In the present invention, a sub 22 houses various downhole data sensors coupled to a downhole data signaling pulser 23. Data measured by the sensors is encoded into digital information by a downhole computer and transmitted by a pulser 23. The information is then transmitted back to the surface by the downhole acoustic data transducer 23 modulating the downwardly flowing stream of drilling mud in the central opening of the drill string 11 with acoustic pulses which transmit the measured parameters to the surface.

Still referring to FIG. 1, the acoustic pulses applied to the stream of drilling fluids in the drill string travel back up the stream through the flexible hose 17 and through the drilling fluid feed conduit 16. In the conduit 16, the pulses are sensed by a pair of receiving acoustic transducers S1 and S2. Acoustic pulses sensed by the transducers S1 and S2 are sent to the downhole MWD data filter and receiver system 24 constructed in accordance with the present invention. The system 24 receives the coded data and decodes it into information as to each of the measured downhole parameters for use by the drilling operator and for recording for future analysis.

As can be seen in FIG. 1, the acoustic transmission line formed by the downwardly flowing stream of drilling fluid is subject to considerable noise generated by the pressure pulses in the mud produced by the mud pump 14 and by flow, drilling and system vibrations. As can also be seen, the acoustic noise pulses generated by pump reciprocation are also subject to reflection. The pulses traveling in a direction down the hole will produce acoustic reflections from each discontinuity and mismatched acoustic impedance in the conduit. For example, where the flexible hose 17 joins the rigid conduit 16 and at the upper end of the drill string 11 an acoustic impedance mismatch is formed at the interface. These reflections, of course, travel in an uphole direction opposite to those from the pump reciprocation pulses and are again reflected from the pump itself and move in the downhole direction. The reflection pulses travel in the same direction as the acoustic data pulses which are to be received and decoded by the data system 24 and the reflected reflections travel in the same direction as the original pump pulses.

In order to improve the quality of downhole data telemetry, as well as increase the speed with which information may be transmitted from downhole measuring means, it is highly desirable to filter from the drilling fluids stream as much as possible of the acoustic noise generated by the pump and various reflections of noise generated within the system itself. The prior art techniques which have been used to provide noise filtration in such systems have involved spacing the receiving transducers in accordance with system geometries to attempt to cancel out repetitive noise pulses and reflections thereof. These systems try to work out a correction for filtration as a function of the distance between transducer pairs and must be placed at predetermined locations on the drilling fluid flow system for maximum effectiveness and filtration or must try to correct electrically with no knowledge of the proper filiation parameters. This places tight restrictions on the physical placement of the transducers and on those operating the system who must try and estimate the proper parameters. The system of the present invention, however, allows the transducers to be placed at the most convenient point on the drilling fluid flow system and perform their filtration with equal effectiveness regardless of the physical location dictated by physcial parameters upon the drilling rig.

Figure 2:
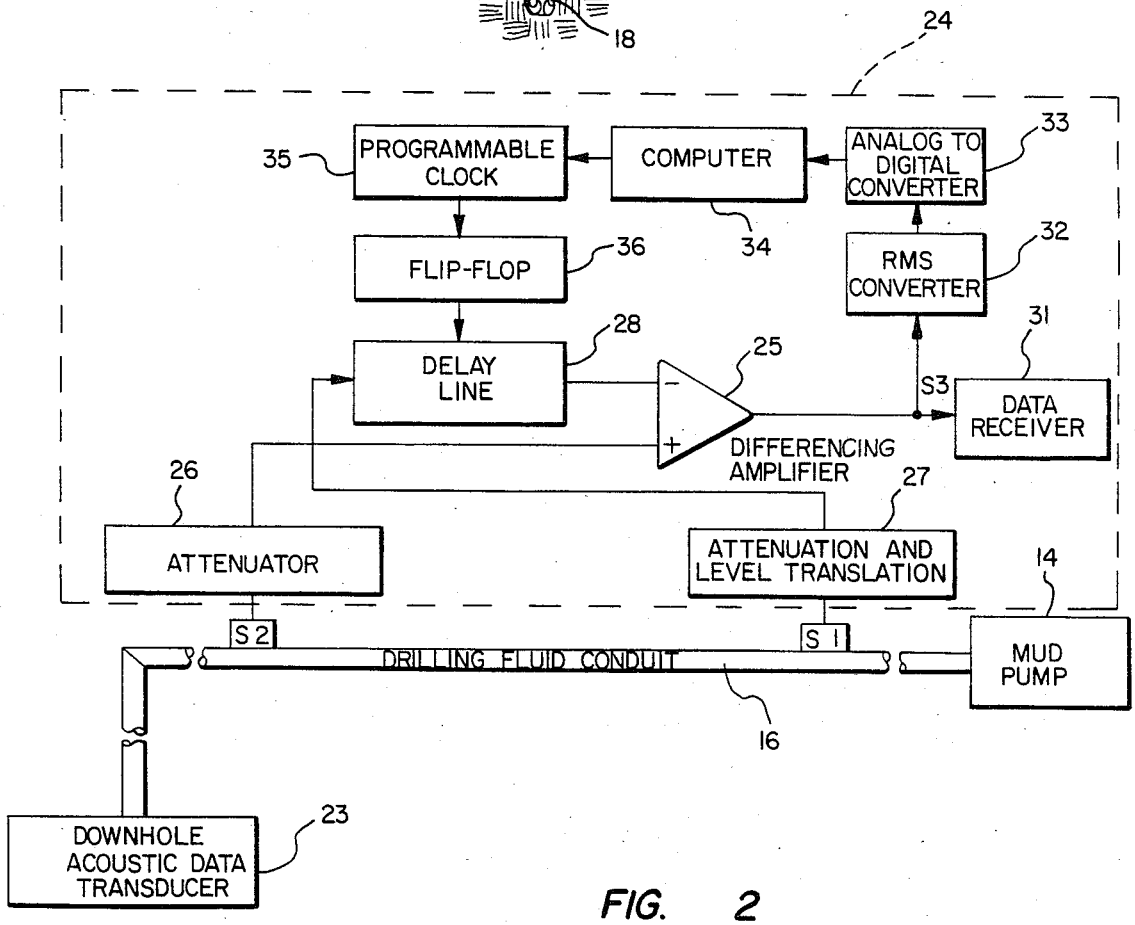
FIG. 2 is a block diagram of an electronic noise filtration system constructed in accordance with the principles of the present invention.

Referring now to FIG. 2, the downhole MWD data filter and receiver system 24 includes means for coupling the output of a first receiving transducer S2 to a first input of a differencing amplifier 25 through an attenuator 26. A second receiving acoustic transducer S1 is connected through an attenuation and level translation circuit 27 and a delay line 28 into a second input of the differencing amplifier 25. The differencing amplifier 25 inverts one of the signals and combines them to produce an output indicative of their difference in value. The output of the differencing amplifier is connected to a data receiver 31 which receives pulse coded information from the downhole data transducer 23. The receiver 31 decodes and sorts the data back into individual signals indicative of the parameters measured downhole. This information provides a recording, or direct indication to the drilling operator, as to the values of those measured downhole parameters. The output of the differencing amplifier 25 is also connected in a feedback loop through an RMS converter 32 and analog to digital converter 33. The output of the converter 33 is connected into a computer 34 which may be any of a number of different types of processing units for performing repetitive calculations as will be further explained hereinafter. The output of the computer 34 is used to adjust the frequency of a programmable clock 35 which is connected to drive a flip-flop circuit 36. The flip-flop circuit 36 drives the stepping of the output signal from the receiving transducer S1 and passes through the delay line 28. The clock frequency, thus, controls the amount of delay of the signal in the delay line 28. The receiving transducers S1 and S2 are, of course, located in direct communication with the stream of flowing drilling fluids passing from the mud pump 14 into the borehole 12. Acoustic data signals propagate from the downhole acoustic data transducer 23 up the fluid stream and convey coded information to the well head.

Figure 3:
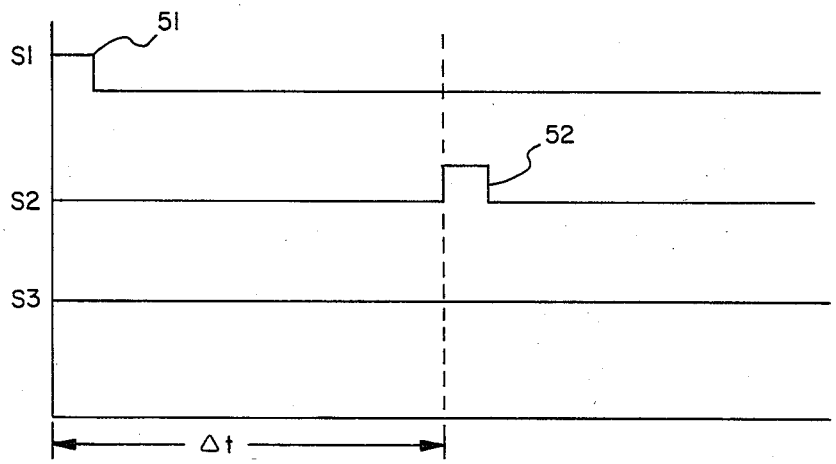
FIG. 3 is a graph illustrating acoustic pulse waveforms of the system of the present invention during a wave calibration mode.

Referring now to FIG. 3, there is shown a calibration mode for the present invention. It may be seen that the pulse signal 51 from transducer S1 can be delayed by a selected time period $\Delta t$ and fed into a comparison circuit along with the pulse signal 52 from transducer S2. It is evident that the time period of delay $\Delta t$ may be adjusted so that pulse 52 cancels pulse 51. Thus, there is required a means for selecting the optimum time period for delaying the fed back acoustic signal in order to optimize the self-cancelling effect. Once the circuitry has been placed on the drilling rig, the frequency of the programmable clock 35 is varied so that an optimal $\Delta t$ is selected. An optimal $\Delta t$ results in noise signals from the mud pump indicated by the pulses 51 and 52 be essentially delayed and fed back through the differencing amplifier to cancel themselves out to produce a completely flat response signal S3. The signal S3 occurs at the output of the differencing amplifier and the input of the data signal receiver.

Referring back again to FIG. 2, the delay line 28 preferably comprises a delay line of the type known as a bucket brigade delay line circuit in which a pair of independent parallel data paths successively transfer data from a series of registers in one of the paths into a next adjacent sequential set of registers in the adjacent path. The rate at which data is transferred to successive stages in the register is a function of the clock frequency at which delay line 28 is driven. Conventionally, delay lines of this type are formed of a plurality of charge coupled devices and may be driven to operate over a very wide frequency range.

The input data signal from the delay line comes from the attenuation and level translation circuit 27 which insures that the data signal to be transferred through the delay line is always positive. This insures proper operation of the charge coupled devices.

The delay line 28 requires a two phase clock for proper triggering operation of the two parallel lines between which data is transferred through the device. A flip-flip circuit 36 is thus provided to drive the delay line 28. The flip-flop 36 is under control of the programmable clock 35 which is capable of operating at a plurality of different frequencies over a relatively wide frequency range. The computer 34 programs the clock to a selected frequency as a function of the value of the data input to it from the analog to digital converter 33. The source of information of data to the analog to digital converter 33 is the RMS converter 32. The converter 32 converts the value difference in the two input signals from the receiving sensors S1 and S2 to its RMS value and thus is a continuous indication of the value of the difference between the two signals and provides a measure of the cancellation of noise achieved by the filter. Therefore, the circuitry of the filter 24 can be adjusted so that the value of the output of the differencing amplifier 25 is minimized when the data transmission circuitry is not in operation. The circuit will thereby adjust the delay line 28 to a proper delay time so that essentially all of the noise in the drilling fluid flow path is inverted and fed back upon itself after its phase has been shifted. Such a phase shift and inversion in differencing amplifier 25 causes the signal to essentially cancel itself out. There are various techniques by which a frequency can be selected at which the programmable clock may be driven for securing the proper delay. In the system of the present invention, a least mean squares technique, well known in the art, has been used in the preferred embodiment.

Figure 5:
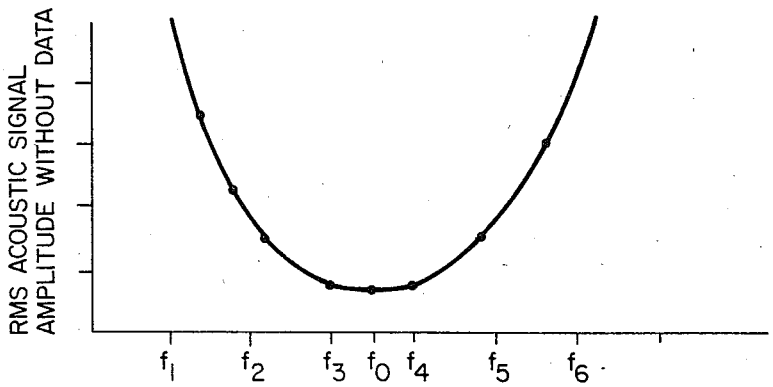
FIG. 5 is a graph illustrating the manner in which the least means squares technique is utilized to adjust the system of the present invention to minimize the acoustic noise therein.

The means for determining $\Delta t$ is understood to be as follows. Referring now to FIG. 5, the RMS acoustic signal amplitude of the signals from the differencing amplifier 25 is shown to be a function of $\Delta t$. The amplitude depends upon the frequency at which the programmable clock 35 is driven and hence the degree of delay introduced by the delay line 28. Different frequencies may be selected about the optimum frequency $f_o$ at which the maximum cancellation is provided and hence the minimum noise level in the circuit is achieved. The computer 34 of FIG. 2 is simply an expeditious means for selecting different frequencies $f_1$ through $f_6$. Arriving at the most desired time delay for the delay line 28 is achieved by selecting various possible frequencies for the programmable clock 35 so that the acoustic noise level on the system is minimized.

Figure 4:
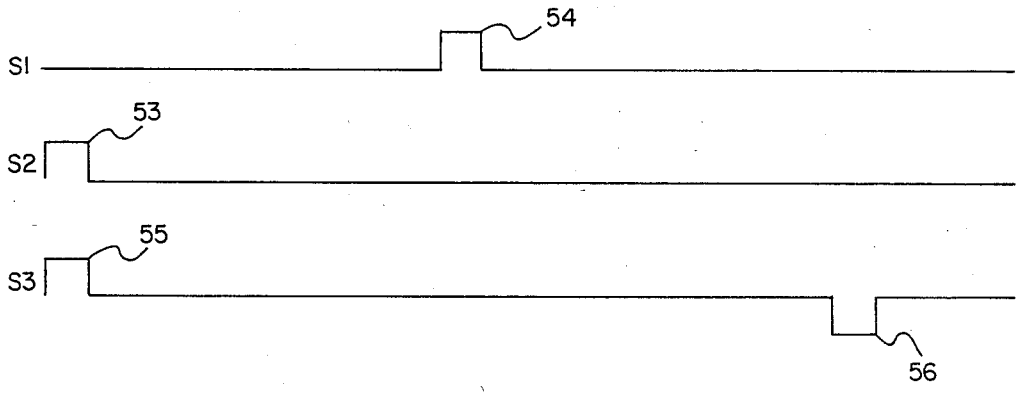
FIG. 4 is a graph illustrating acoustic pulse waveforms of the system of the present invention during a wave transmission mode.

Once the system has been calibrated, signals on the system during data transmission are shown in the illustration of FIG. 4 wherein data pulses received as signals 53 and 54 appear as pulses 55 and 56, being of opposite polarity and spaced in time from real time indications.

Figure 6:
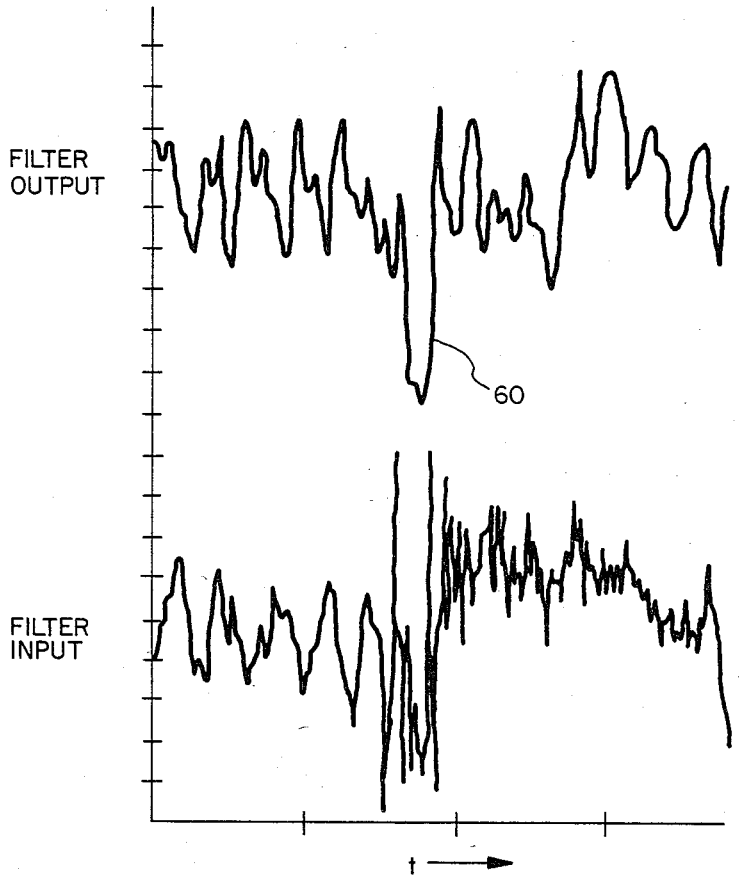
FIG. 6 is a graph illustrating acoustic noise reduction in a drilling fluid flow path by the system of the present invention.

In FIG. 6, there is shown a graphical illustration in the lower portion of acoustic data signals S3 received at the data receiver 31. The output of the filter is shown in the upper curve of the graph of FIG. 6 as a function of the filter input indicated in the lower portion thereof. As can be seen, the filter is very effective in removing ambient noises from the data pulse 60 shown in the upper curve. The filtration system of the present invention is also very effective in removing all the various noise and echoes produced by the mud pump echoes as well as other sources of acoustic noise within the drilling fluid flow path.

The foregoing description of the invention has been directed primarily to a particular preferred embodiment in accordance with the requirements of the patent statutes and for purposes of explanation and illustration. It wil be apparent, however, to those skilled in the art that many modifications and changes in the specifically described and illustrated apparatus and method may be made without departing from the scope and spirit of the invention. Therefore, the invention is not restricted to the particular form of construction illustrated and described, but covers all modifications which may fall within the scope of the following claims. It is Applicants' intention in the following claims to cover such modifications and variations as fall within the true spirit and scope of the invention.

What is claimed is:

1. An apparatus for use in borehole data transmission systems in which downhole data is transmitted by acoustic pulses propagated through drilling fluid contained within a fluid flow line, said apparatus comprising:

a pair of acoustic receiving transducers to be spaced one from another any distance on said flow line, each said transducer adapted for receiving said acoustic pulses propagating in said drilling fluid and producing a respective output signal in response thereto;

means for determining the difference in the output signals of said transducers; and means for selectively delaying one of said output signals to said difference determining means as a function of said difference during the absence of downhole data transmission to minimize said difference and eliminate acoustic noise in said flow line.

2. The apparatus of claim 1 wherein said delaying means comprises:

a variable delay line varied as a function of an output from said difference determining means.

3. The apparatus of claim 1 further comprising:

means to convert said output from said difference determining means to a root mean square value; and means to control said delay line to produce a minimum root mean square value.

4. The apparatus of claim 3 further comprising:

means to convert said root means square value from an analog to a digital signal.

5. The apparatus of claim 4 further comprising:

computer means responsive to said digital signal and programmed to select a frequency with a least mean square technique.

6. The apparatus of claim 5 further comprising clock means responsive to said computer means to produce an output determining the frequency at which said control means operates.

7. The apparatus of claim 6 wherein said control means is a flip-flop circuit.

8. A system for filtration of acoustic noise in an acoustic data transmission system comprising:

a pair of acoustic receiving transducers spaced from one another an any distance on a transmission line, each transducer adapted to receive pulses and to produce a respective output signal in response thereto;

means for determining the difference in the output signals of the two transducers;

means for selectively delaying one of said output signals to said difference determining means; and means for controlling said delaying means as a function of the difference in the output signals during the absence of downhole data transmission to minimize said difference and thereby eliminate acoustic noise on said transmission line.

9. The system of claim 8 wherein said delaying means comprises:

a variable delay line wherein said delay is varied as a function of an output signal from said difference determining means.

10. The system of claim 8 further comprising:

means to convert an output signal from said difference determining means to a root mean square analog value; and circuit means connected from said means to convert to said delaying means to produce a minimum root mean square value.

11. The system according to claim 10, said circuit means further comprising means to convert said root mean square analog value to a digital signal.

12. The system according to claim 11, said circuit means further comprising computer means responsive to said digital signal and programmed to select a frequency with a least means square technique.

13. The system according to claim 12, said circuit means further comprising programmable clock means responsive to said computer means and connected to control a flip flop circuit.

14. The system according to claim 13 wherein said flip flop circuit is responsive to said programmable clock means forming a closed loop to produce said minimum root mean square value.

15. A method of borehole data transmission through drilling fluid contained within a flow line comprising the steps of:

providing means for transmission of downhole data by acoustic pulses propagated through said drilling fluid;

providing first and second receiving transducers spaced from one another at any distance along said flow line, each said transducer adapted to receive said acoustic pulses and produce a respective signal output in response thereto;

determining the difference in the signal outputs of said first and second transducers; and selectively delaying one of said two signal outputs as a function of said determined difference in the signal outputs during the absence of downhole data transmission to minimize said difference and thereby eliminate acoustic noise in said flow line.

16. The method of claim 15 wherein said selectively delaying step comprises:

providing a variable delay line; and varying said selective delay as a function of the difference in the signal outputs.

17. The method according to claim 15 wherein said step of delaying one of said two signal outputs comprises:

converting said difference in the to a root mean square value; and selecting a frequency for a delay line to produce a minimum root mean square value.

18. The method according to claim 15 wherein said frequency selecting step comprises:

applying a least mean square technique.

* * * * *

UNITED STATES PATENT AND TRADEMARK OFFICE

CERTIFICATE OF CORRECTION

PATENT NO. : 4,590,593

DATED : May 20, 1986

INVENTOR(S) : Paul F. Rodney

It is certified that error appears in the above—identified patent and that said Letters Patent is hereby corrected as shown below:

In column 7, line 51, change "1" to --2--.

In column 8, line 6, delete "an".

In column 9, line 4, after "the" insert --signal outputs--.

In column 10, line 3, change "15" to --17--.

Signed and Sealed this

*Twenty-third* Day of *September 1986*

[SEAL]

*Attest:*

DONALD J. QUIGG

*Attesting Officer* *Commissioner of Patents and Trademarks*